United States Patent [19]

Tatsuno

[11] Patent Number: 5,040,243

[45] Date of Patent: Aug. 20, 1991

[54] GARMENT WITH A COVERING

[75] Inventor: Isamu Tatsuno, Sakai, Japan

[73] Assignee: Mont-Bell Co., Ltd., Japan

[21] Appl. No.: 536,025

[22] Filed: Jun. 11, 1990

[30] Foreign Application Priority Data

Jul. 28, 1989 [JP] Japan ..... 1-195563

[51] Int. Cl.[5] ..... A41D 1/02

[52] U.S. Cl. ..... 2/108; 2/69; 2/87; 2/85; 2/93; 2/94

[58] Field of Search ..... 2/108, 69, 85, 93, 94, 2/87, 115, 84

[56] References Cited

U.S. PATENT DOCUMENTS

| | | | |
|---|---|---|---|
| 1,088,891 | 3/1914 | Filson | 2/115 |
| 2,682,056 | 6/1954 | Werber | 2/84 |
| 4,217,663 | 8/1980 | Goldberg et al. | 2/102 |
| 4,470,155 | 9/1984 | Maeshima | 2/108 |
| 4,502,154 | 3/1985 | Itoi | 2/108 |
| 4,771,479 | 9/1988 | Silver | 2/85 |

FOREIGN PATENT DOCUMENTS

| | | | |
|---|---|---|---|
| 2401626 | 3/1979 | France | 2/108 |
| 2586535 | 3/1987 | France | 2/108 |

*Primary Examiner*—Werner H. Schroeder
*Assistant Examiner*—Gloria Hale
*Attorney, Agent, or Firm*—Oliff & Berridge

[57] ABSTRACT

A garment comprising a main garment body having a sack or accommodation means on the back side thereof, and a covering normally packaged in the sack and adapted to be taken out of the sack and worn over the sack. The sack accommodating the covering is provided on the back of the main garment body. The opening and closing of the sack can be easily done by the user, so that the user may take the covering out of the sack to put it on or take off the covering and put it back in the sack as required.

11 Claims, 5 Drawing Sheets

10: 本体充服
12: 袋体

10: 本体衣服
12: 袋体
24: 外套

GARMENT WITH A COVERING

BACKGROUND OF THE INVENTION

1. Field of the Invention

The present invention relates to clothes or garments and, more particularly, to a garment which is provided with a covering such as a weather-protective cover adapted to be put on the garment.

2. Description of the Related Art

In general, one given garment is not suitable with all types of weather. When weather condition is expected to change, one wears a basic garment and preferrably carries additional coverings such as a wind breaker or weather-protective cover which may become necessary.

For instance, in hiking or mountain climbing, while wearing a garment having high air permeability is sufficient for active work or exercise during mild weather, it may become necessary to wear additional clothes having low air permeability when strong wind begins to blow or when the air temperature becomes low due to a sudden change in weather. Conversely, one sometimes starts exercise wearing a covering such as a wind breaker over basic training clothes, and after the body is warmed up, the covering is taken off.

Hitherto, therefore, it has been necessary to carry the coverings in hand or in a knapsack, bag or the like while the weather condition does not require to wear them. It is quite laborious and troublesome to carry such coverings in hand or to take the coverings out of the knapsack or bag each time the weather changes, particularly in cases of a long-distance hiking, mountain climbing or an exercise.

Convenience in carrying the covering, as well as in putting them on and off, is desirable not only in mountain climbing or exercise but also in daily life.

SUMMARY OF THE INVENTION

Accordingly, an object of the present invention is to provide a garment with a covering which enables a user who wears the garment to carry the covering in an unencumbered manner and to put it on easily over the garment whenever it becomes necessary.

To this end, according to the invention, there is provided a garment comprising a main garment body having a sack or accommodation means on the back side thereof, and a covering normally packaged in the sack and adapted to be taken out of the sack and worn over the sack. Since the sack accommodating the covering is provided on the back of the main garment body, the covering can be carried without encumbrance when the weather condition does not require the user to put it on. The opening and closing of the sack can be easily done by the user, so that the user can easily take the covering out of the sack to put it on or take off the covering and put it in the sack as required.

DESCRIPTION OF THE PREFERRED EMBODIMENTS

Figure 1:
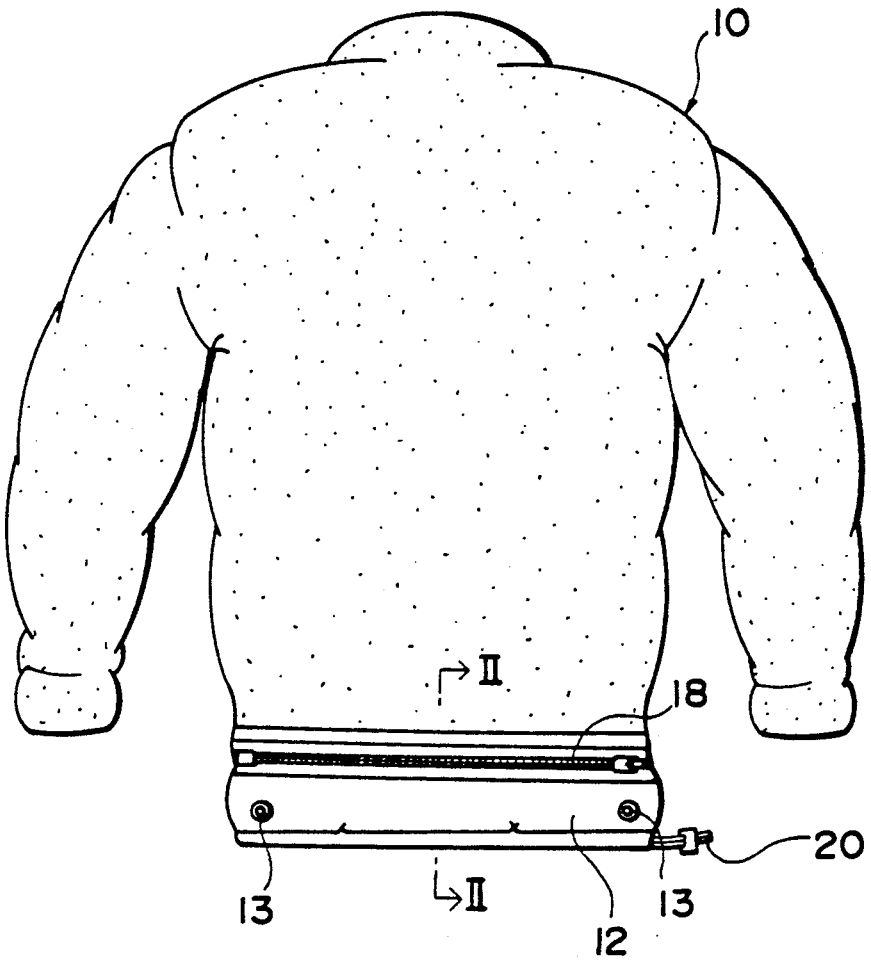
FIG. 1 shows an embodiment of a garment with a covering in accordance with the present invention, as viewed from the back side thereof.
Figure 2:
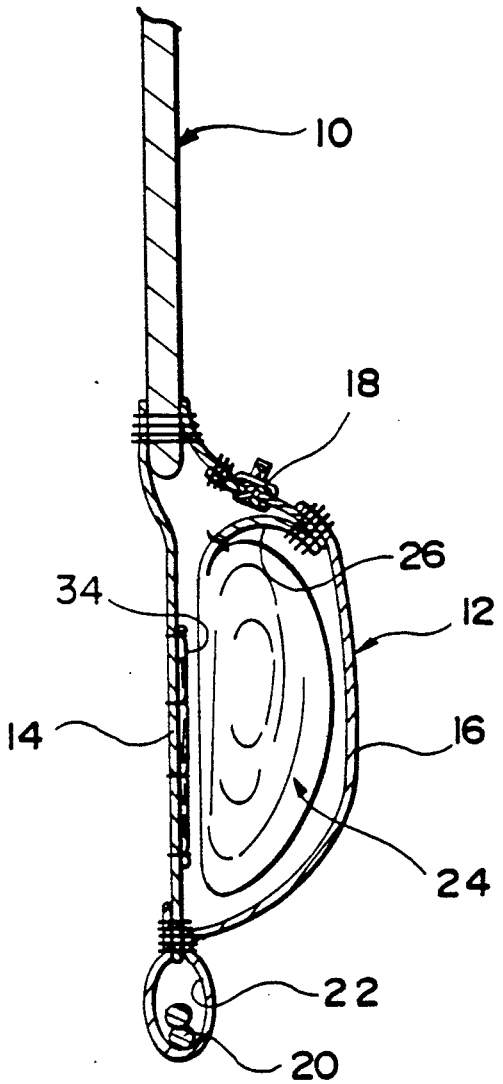
FIG. 2 is an enlarged sectional view taken along the line II—II of FIG. 1.
Figure 3:
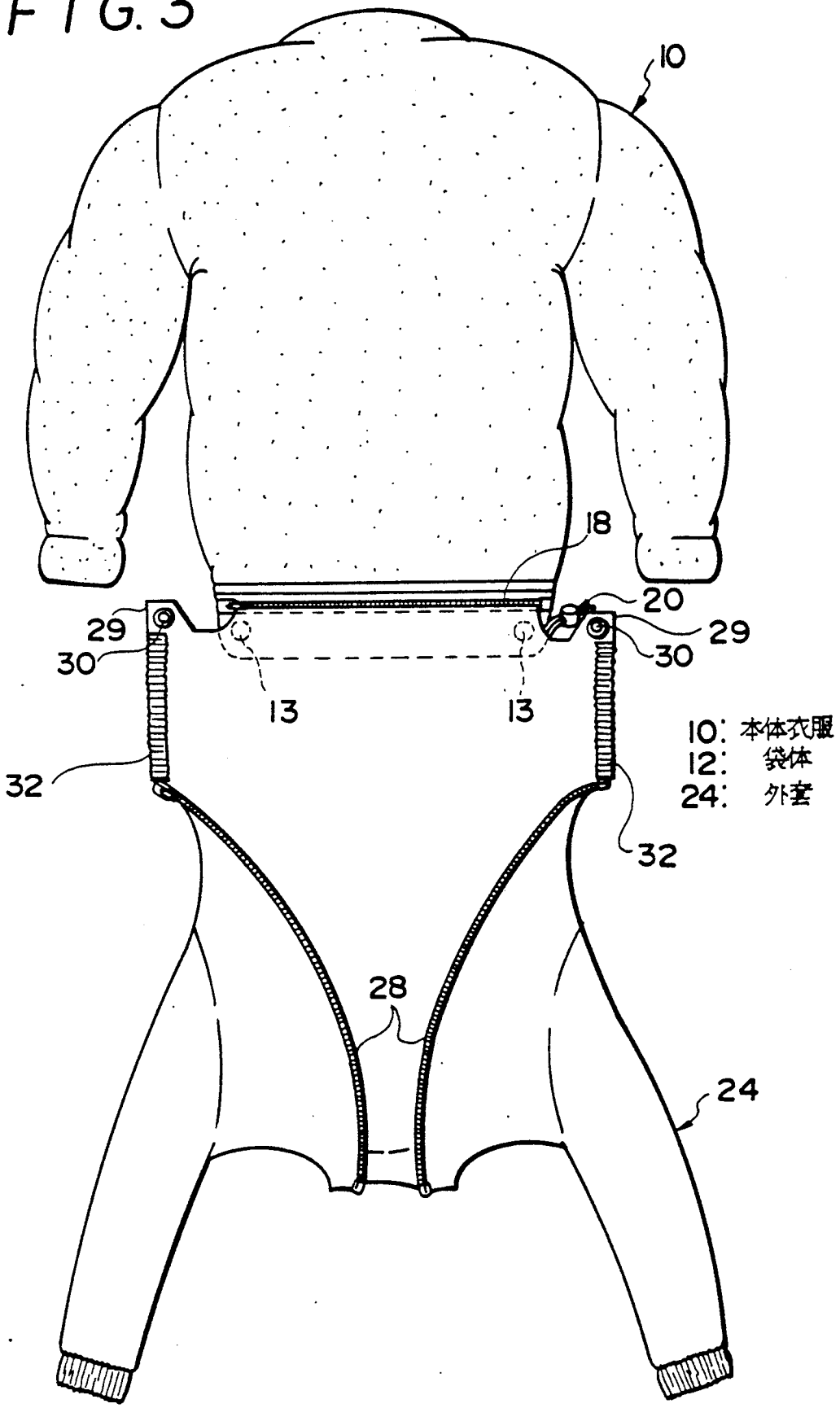
FIG. 3 is a rear elevational view of the embodiment with a covering taken out from a sack.

FIGS. 1 to 3 shows an embodiment of the garment with a covering in accordance with the present invention suitable for use by a mountain climber. The garment has a main garment body denoted by 10 which is made of an air-permeable and heat-preserving material. The garment main body may be designed substantially in the same manner as ordinary clothes or a jacket of this kind. Thus, the main garment body 10 may be of no-sleeve type, ordinary type in which the front side can be opened and closed by a fastener, or pull-over type.

The main garment body 10 is provided with a sack 12 at the lower end of the back side thereof, i.e., at the back waist portion thereof. As will be seen also from FIG. 2, the sack 12 has an inner web 14, an outer web 16 and a fastener 18 which extends substantially horizontally along the top edge of the outer web 16. A passage 22 for a waist cord 20 for tightening the lower end portion of the main garment body 10 is provided on the bottom of the outer web 16. As will be explained later, the outer web 16 forms the lower end portion of the covering when the user wears the covering, so that it is preferred from a view point of appearance that the outer web 16 is made of the same material and has the same color as the covering. Numeral 13 denotes a pair of hooks provided on the outer web 16.

The covering, which is denoted by 24, is normally accommodated in the sack 12. As shown in FIG. 3, the lower end edge of the covering is sewed to a portion of the sack 12 so that it does never come off the sack 12 when taken out the sack after opening the fastener 18 (see FIG. 2). In order to prevent the lower edge portion 26 of the covering from being folded back when the covering 24 is spread over the main garment body 10, the outer surface of the lower edge portion 26 of the covering is faced and jointed to the inner surface of the outer web 16 by sewing.

As will be seen from FIG. 3, the covering 24 is sized to be large enough to cover the main garment body 10. The covering 24 in the state worn by the user has a front portion which is composed of left and right half portions separable from and connectable to each other by suitable means such as a fastener 18. Numeral 29 denotes tabs which project from the left and right lower ends of the covering 24 when the latter is worn by the user. Hooks 30 provided on these tabs 29 are engageable with the aforementioned hooks 13 on the outer web 16 of the sack 12. Numeral 32 denotes pleat portions which extend from both sides to front portions along the lower edge of the covering. Preferably, rubber cords are extended through these pleat portions so as to allow the pleat portions to expand and shrink.

For an easy packaging, the garment covering 24 is preferably made of a flexible, thin material from the view point of compact packaging in the sack 12. It is also preferred that the material of the covering is air-impermeable and/or of waterproof material such as nylon, in order to be a weather-protective cover for protecting the wearer's body from wind, rainfall and so forth.

A description will be given of the manner of use of the embodiment, with specific reference to FIGS. 4 to 7.

Figure 4:
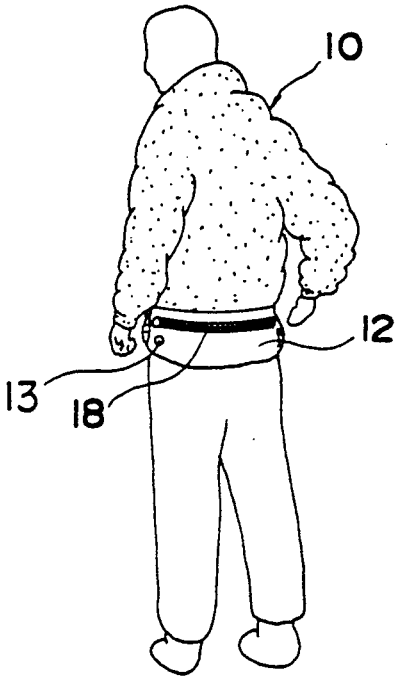
FIGS. 4 to 7 are illustrations in the order of the manner in which a wearer clothed in main garment body puts the covering over the main garment body, respectively.
Figure 5:
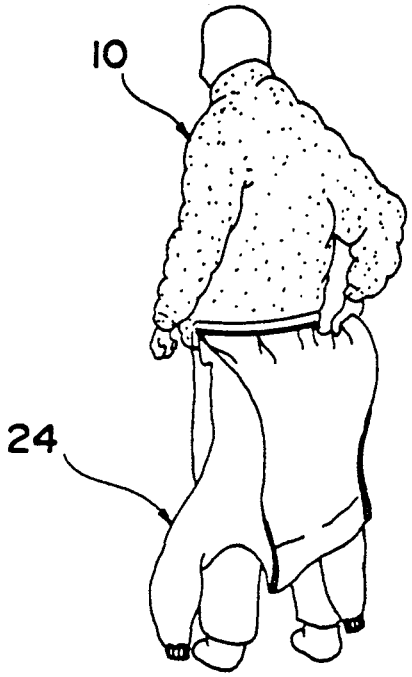
Figure 6:
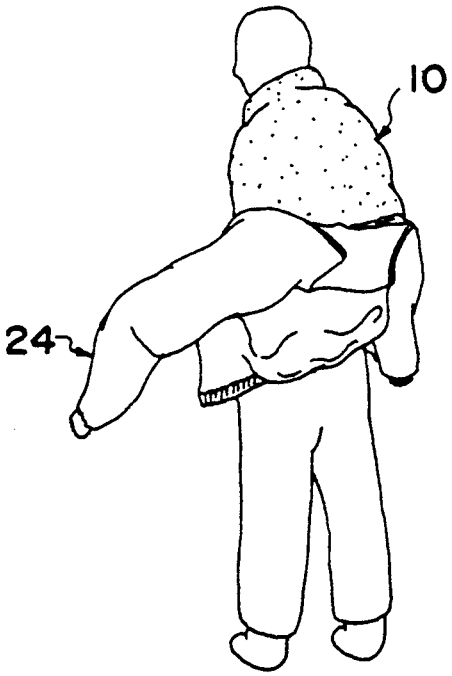
Figure 7:
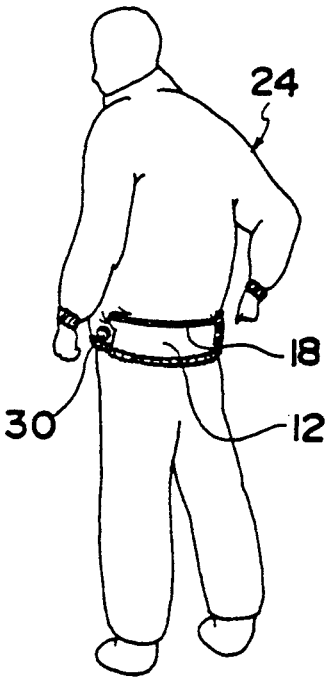

FIG. 4 illustrates the main garment body 10 worn by the user, with the covering packaged in the sack 12. When the user wishes to put on the covering, he may extend his arms to the back to open the fastener 18 and takes the covering 24 out of the sack 12, as shown in FIG. 5. Then, the user pulls the covering 24 up while inserting his arms into sleeve portions as shown in FIG. 6, and then closes the front fastener 28 thus completing wearing of the covering 24. In this state, the portions of the covering 24 between the lower edge 26 sewed to the sack 12 and both pleat portions 32 on both sides tend to be turned over to expose the main garment body 10. In the described embodiment, however, the user can pull the tabs 29 to bring the hooks 30 thereon into engagement with the hooks 13 on the inner web of the sack 12 so that the above-mentioned portions can be fastened to the sack 12 (see FIG. 7) Since the outer web 16 is made of the same material as the covering 24, it gives an impression that the whole area of the back of the user is covered by integral back portion of the covering 24, thus improving appearance. In this state, the lower rail of the fastener 18 on the sack 12 is exposed.

In the described embodiment, the main garment body 10 and the covering 24 are designed in such a manner to coat the upper portion of the user's body above the waist. This, however, is only illustrative. The main garment body and/or the covering may be designed to cover the body from the neck down to the ankles, or additional coverings may be added for covering only the lower part of the body below the waist.

The sack 12 with the covering packaged therein tends to expand or inflate to become bulky. In order to avoid such expansion of the sack 12, it is preferable to sew a rubbery material 34 (see FIG. 2) along the inner surface of the sack 12 so as to contract the sack. Such a rubbery material, when used, is preferably sewed to the inner surface 14 of the sack, from the view point of improvement in the appearance.

Although the described embodiment employs the fastener 18 as a means for opening and closing the sack 12, other alternative means such as hooks, buttons or Velcro fastener can be used as desired.

Figure 8:
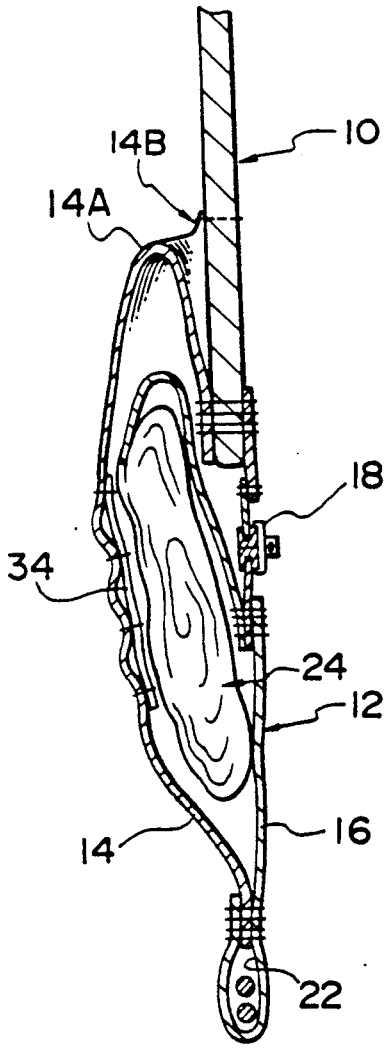
FIG. 8 is an enlarged sectional view of a second embodiment, taken along a plane corresponding to that of FIG. 2.

FIG. 8 shows another embodiment of the present invention which is designed to prevent outward projection of the sack when packaging the covering. In this Figure, the same reference numerals are used to denote the same parts or members as those in FIG. 2 and detailed description of such parts or members is omitted.

The inner web 14 of the sack 12 has greater size than the outer web 16 so that the inner web 14 has an excessive portion even in the state in which the outer web 16 is fully stretched and flattened. The upper end portion of the inner web 14 is tucked and sewed to the lower end on the inner surface of the main garment body 10 and the left and right end portions 14B of the tucked portion 14A, as viewed from the rear side of the wearer, are locally sewed to the main garment body 10 so as to prevent the inner web 14 from drooping. It is to be understood that only the right end portion 14B is illustrated in FIG. 8. In addition, on elastic rubbery material is sewed to the inner surface of the inner web 14 at the central region thereof, thereby preventing fluttering of the inner web 14 particularly when the covering 24 has been taken out, while preventing drooping of the inner web 14.

The embodiment shown in FIG. 8, having the above-described feature concerning the inner web 14 of the sack 12, offers the following advantages. The sack 12 when accommodating the covering 24 inflates or expands inward, i.e., to the left as viewed in FIG. 8, rather than projecting outward, such that the tucked portion 14A slightly projects upward. In consequence, any feel of disorder of appearance of the main garment body 10 worn by the user with the covering 24 packaged will be eliminated. Conversely, when the covering 24 is taken out of the sack 12, there is no risk for the inner web 14 to slacken and thus partially appear at the lower end of the main garment body 10 or the lower end of the outer web 16 of the sack 12, partly because the elastic rubbery material 34 on the inner web 14 contracts in the inner web 14 and partly because the left and right end portions 14B of the upper tucked portion 14A are sewed to the main garment body 10.

As will be fully understood from the foregoing description, the garment with a covering of the invention has a main garment body having accommodation means on the back side thereof, and the covering is normally packaged in the sack. The user wears the main garment body with covering packaged in the sack when the covering is unnecessary, whereas, when it becomes necessary to wear to the covering, the user can easily open the sack and wear the covering over the main garment body. Thus, a single garment can be adapted for use in a variety of conditions.

What is claimed is:

1. A garment comprising:

a main garment body;

accommodation means on the back of said main garment body; and a covering accommodated in said accommodation means and replaceably removeable from said accommodation means and worn over said main garment body;

wherein said accommodation means is a flexible sack formed integrally on the back of said main garment body; and wherein an outer surface of said sack is exposed on the back of said main garment body and lower edges of said covering are fixed to said sack, whereby said outer surface of said sack defines lower parts of said garment body when the covering is accommodated within said sack and defines lower parts of the covering when the covering is put over said garment body.

2. A garment comprising:

a main garment body;

accommodation means on the back on said main garment body, wherein said accommodation means comprises an outer web exposed on the back of said main garment body and an inner web having a larger size than said outer web so as to define a sufficient space inside said main garment body;

a covering accommodated in said accommodation means and replaceably removeable from said accommodation means and worn over said main garment body; and elastic means on said inner web for contracting said inner web particularly when the covering is taken out of said sack.

3. A garment as in claim 2, wherein upper portions of opposed side edges of the inner web are fixed to an inner face of the main garment body.

4. A jacket, having a back waist portion at substantially the waist line of a wearer of the jacket, comprising:

a sack integrally provided at the back waist portion of said jacket, said sack comprising an outer web defining a lower end portion of the jacket and an inner web defining, in cooperation with said outer web, a space inside said jacket, said inner web having a larger size than said outer web;

an elastic member on said inner web to contract any excess portion of said inner web; and a weather-protective cover accommodated within said space of said sack and said cover being replaceably removeable from the sack to be put over said jacket, said cover having a lower edge fastened to an inner face of said sack.

5. A garment comprising:

a main garment body having a back extending to the waist or hip portion of a wearer;

a sack formed integrally on the back of said main garment body at substantially the waist or hip portion of said back; and a second flexible garment body accommodated in said sack and said cover being replaceably removeable from said sack and worn over said main garment body;

said second garment body being fixed with said sack, whereby, said second garment body, when taken out of said sack, is attached to said main garment body.

6. A garment as set forth in claim 5, wherein said accommodation means further comprises fastener means for manual operation to open and close an opening of said accommodation means.

7. A garment as set forth in claim 5, wherein said second garment body has its lower end at substantially the waist line of a wearer.

8. A garment as in claim 5, wherein a portion of the main garment body forming the sack is of the same material as the second garment body.

9. A garment as in claim 5, and further comprising at least one fastening element on the portion of the main garment integrally forming said sack and least one cooperating fastening element on the second garment body for detachedly connecting a portion of the second garment body to the main garment body.

10. A garment as in claim 5, and further comprising:

contracting means disposed on side edges of the second garment body for contracting portions of the second garment body.

11. A garment as in claim 10, wherein the contracting means are disposed on portions of the on side edges of the second garment body adjacent the sack.

* * * * *